US005283908A

United States Patent [19]

Martin

[11] Patent Number: 5,283,908

[45] Date of Patent: Feb. 8, 1994

[54] ELASTIC GARMENT WITH DISPLACEABLE SECTION

[75] Inventor: Frances C. Martin, Sun City West, Ariz.

[73] Assignee: Martin Enterprises, Sun City West, Ariz.

[21] Appl. No.: 911,180

[22] Filed: Jul. 9, 1992

[51] Int. Cl.[5] ..... A41B 9/02; A41D 27/00

[52] U.S. Cl. ..... 2/69; 2/79; 2/408; 2/78.2; 2/78.3; 450/102

[58] Field of Search ..... 2/67, 69, 69.5, 78 R, 2/78 A, 78 B, 78 C, 78 D, 79, 109, 110, 227, 406, 408, 409; 450/102, 103, 104, 105

[56] References Cited

U.S. PATENT DOCUMENTS

| | | | |
|---|---|---|---|
| Re. 19,380 | 11/1934 | Craig | 2/78 B |
| 1,179,159 | 4/1916 | Buley | 2/407 |
| 1,965,213 | 7/1934 | Bernstein | 2/79 |
| 1,993,568 | 3/1935 | Rosenberg . | |
| 2,018,666 | 10/1935 | Flesh . | |
| 2,093,902 | 9/1937 | Bernstein | 2/78 B |
| 3,023,419 | 3/1962 | Strahle . | |
| 3,068,488 | 12/1962 | Rodriguez . | |
| 3,088,116 | 5/1963 | Simonoff | 2/79 X |
| 3,678,514 | 7/1972 | Safrit | 2/409 |
| 3,777,764 | 12/1973 | Herbener . | |
| 5,042,092 | 8/1991 | Ewing . | |
| 5,060,315 | 10/1991 | Ewing | 2/69 |

FOREIGN PATENT DOCUMENTS

| | | | |
|---|---|---|---|
| 460901 | 6/1928 | Fed. Rep. of Germany | 2/67 |
| 49759 | 7/1939 | France | 2/67 |

*Primary Examiner*—Clifford D. Crowder
*Assistant Examiner*—Jeanette E. Chapman
*Attorney, Agent, or Firm*—Loren H. Uthoff, Jr.

[57] ABSTRACT

An elastic garment stretched from the wearer's shoulders to the legs and encircling the wearer's legs with leg portions and having a crotch section covering the wearer's crotch and having a posterior opening which is covered by a posterior cover formed by an extension section which is attached to a waistband and extends from the waistband to the leg portions and the crotch section. To perform bodily functions, the wearer pushes the waistband downward which displaces the posterior cover thereby exposing the wearer's posterior through the posterior opening and displaces the crotch section to expose other private parts which are further exposed when the wearer assumes a sitting position. The garment remains stretched between the wearer's shoulders and legs and is easily returned to a normal wearing position upon standing and repositioning of the waistband to the wearer's waist.

7 Claims, 4 Drawing Sheets

FIG 1
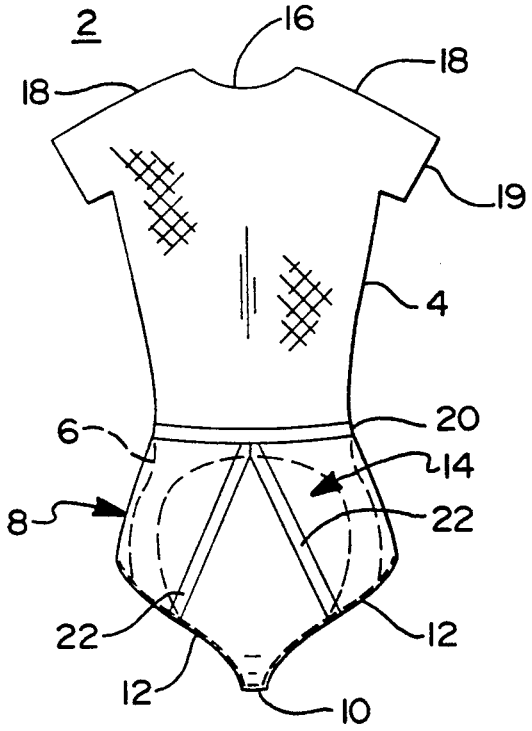
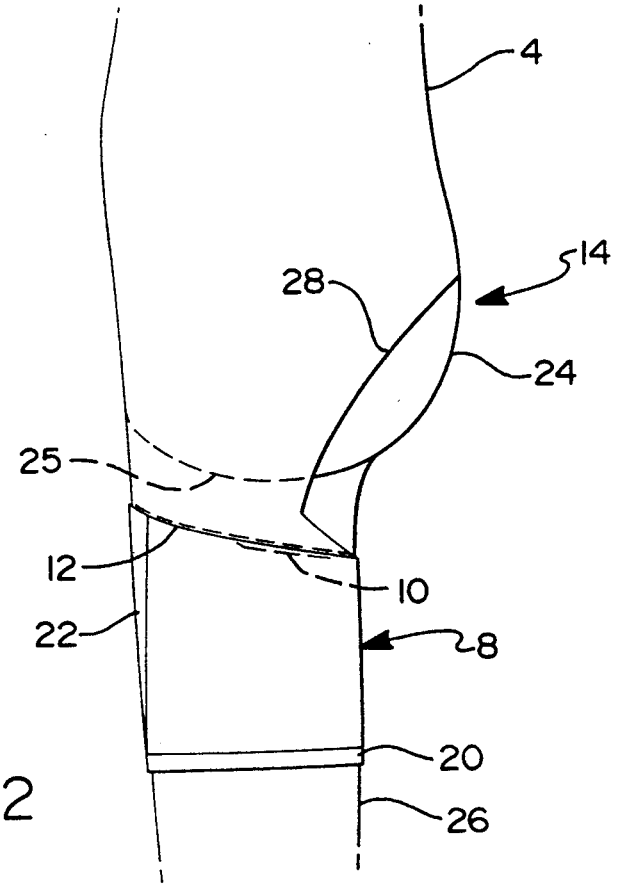
FIG 2

FIG 3
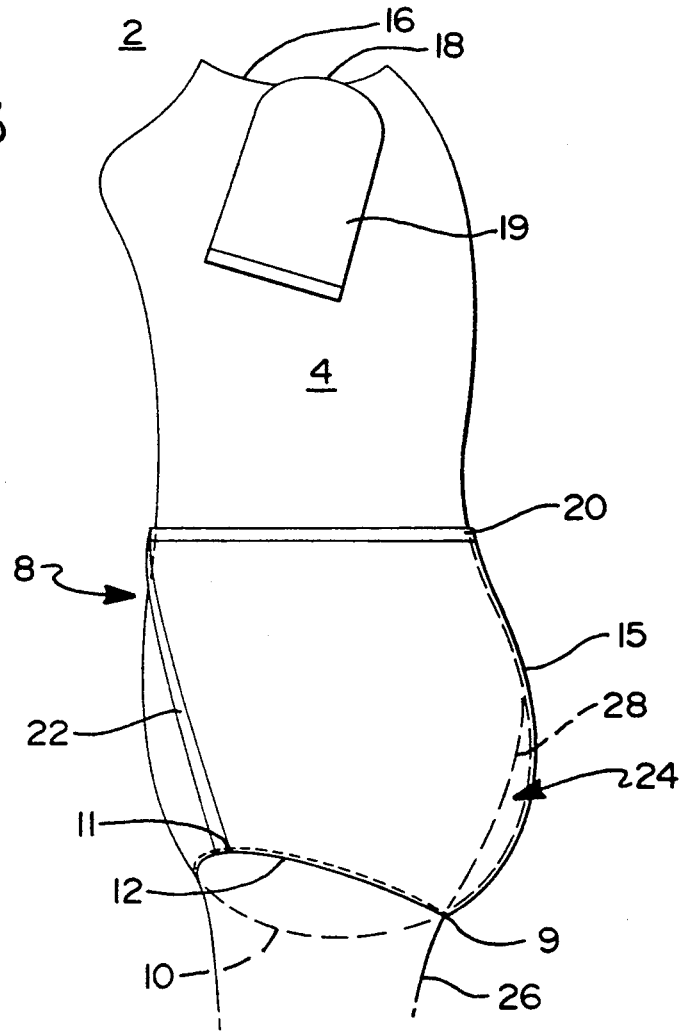
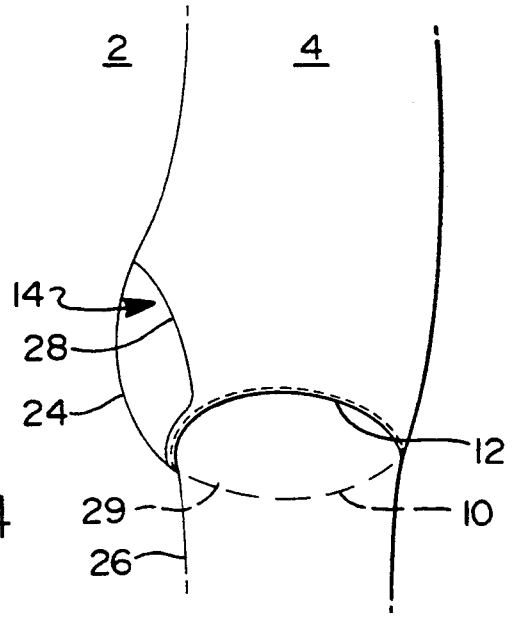
FIG 4

FIG 5
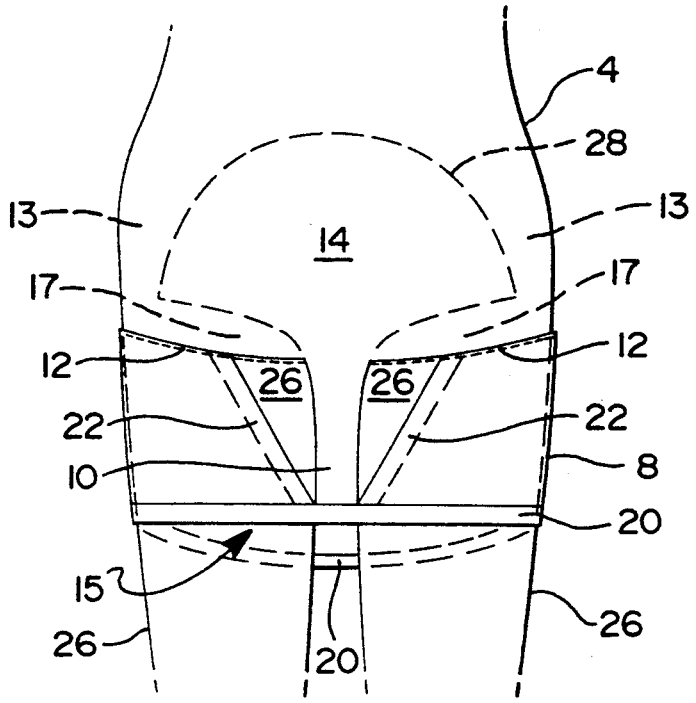
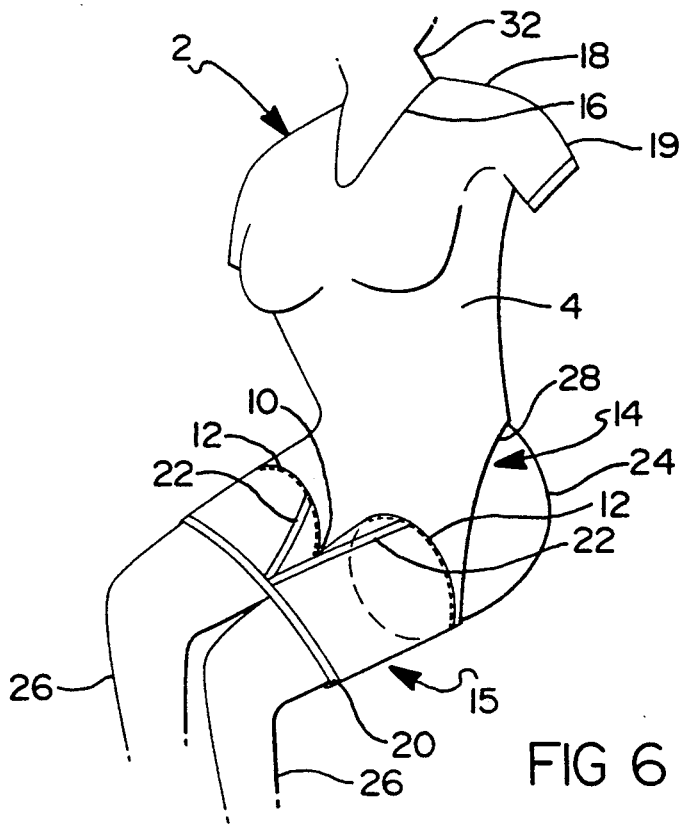
FIG 6

FIG 7
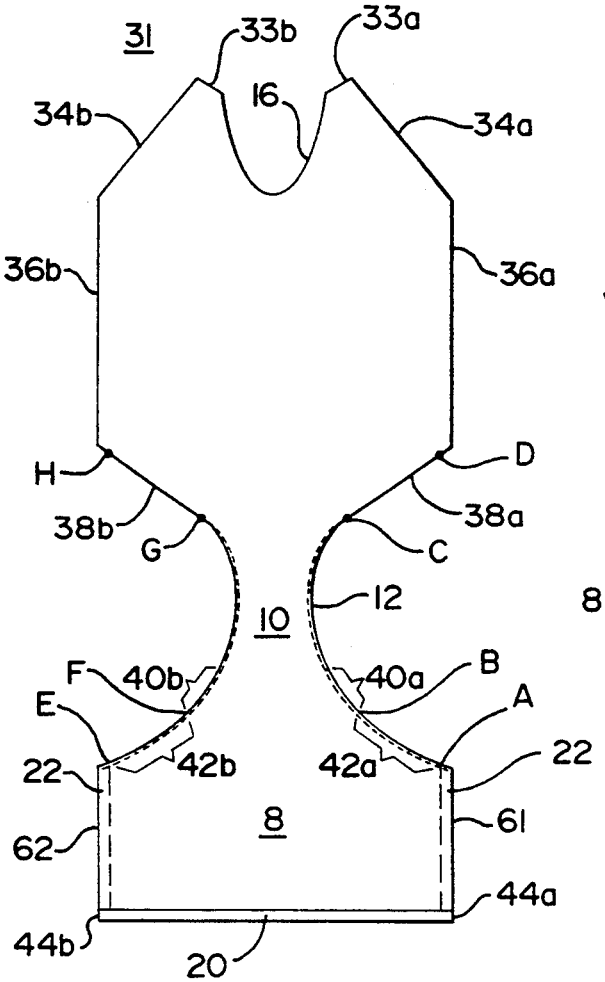
FIG 9
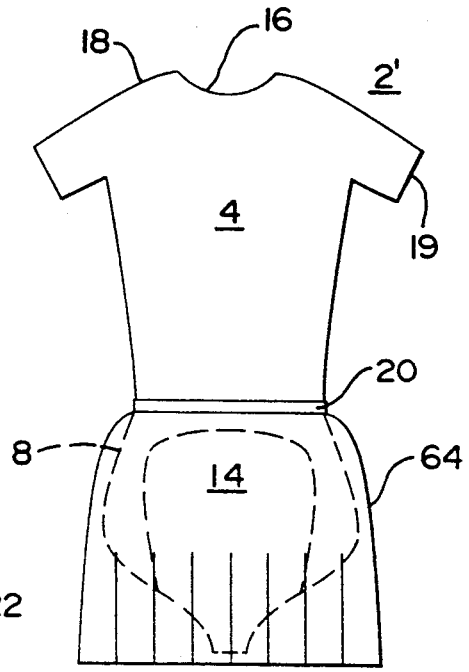
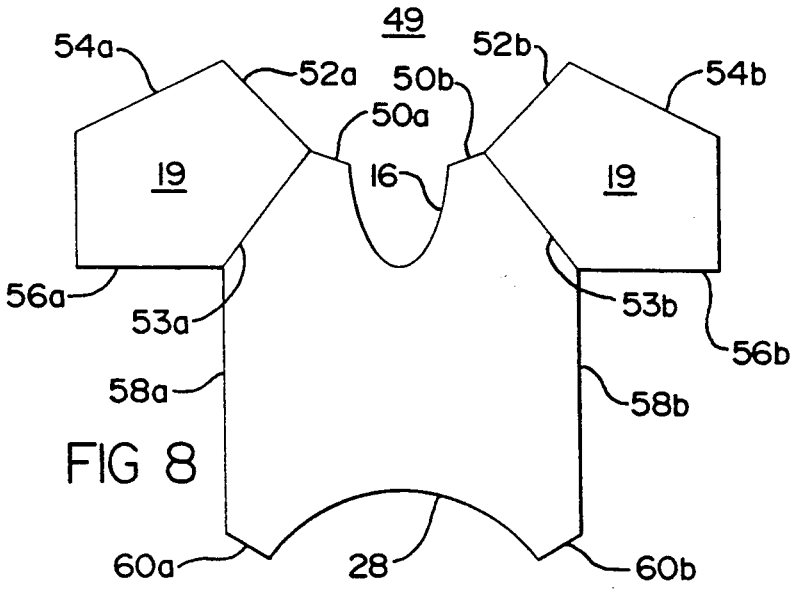
FIG 8

ELASTIC GARMENT WITH DISPLACEABLE SECTION

FIELD OF THE INVENTION

This invention relates to an elastic garment which permits the wearer to easily displace a section of the elastic garment for performance of bodily and hygienic functions. More particularly, this invention relates to a one-piece elastic garment which is stretched from the wearer's shoulders to the wearer's legs where a section of the garment is displaced to expose private areas when the wearer assumes a sitting position to attend to bodily and hygienic functions.

DESCRIPTION OF THE PRIOR ART

The prior art has recognized the great need for an elastic garment, one type of which is a leotard, designed to allow the wearer to perform bodily and hygienic functions without removing the upper section of the garment from the shoulders. Removal of the upper section of an elastic garment such as a leotard is quite difficult for a number of people including those having physical disabilities or those young in age. Also, it is desirable to wear an elastic garment that allows for the quick performance of bodily elimination functions when a performer is involved in a show due to the short time available between acts.

To date, no garment has provided the feature of allowing the wearer to easily displace a section of the garment and then assume a sitting position on a commode where the wearer's posterior section and other private areas are exposed for elimination or hygienic attention, while full support is provided from the shoulders to the legs. Also, no garment has been disclosed which allows for the virtual automatic repositioning of the garment back into the normal position after the wearer re-assumes a standing position without complications. These features would allow for the full support of the elastic garment at all times with easy repositioning after performing bodily and personal hygienic functions.

U.S. Pat. No. 3,068,488 discloses a garment which has a main section which includes a crotch section which is split front to rear. A separate section covers the split crotch section when worn in the normal position. When the wearer wants to perform a bodily function, she lowers the auxiliary section along the legs thereby exposing the split crotch section. She then must use both hands to pull the sides of the split crotch apart to expose her private parts. This operation then leaves no hands available for placement of a hygienic device and is generally unsanitary to the wearer and uncomfortable during elimination.

U.S. Pat. No. 5,042,092 discloses an elastic garment which has a main section which has no lower portion to engage the wearer's legs. The main section is attached to an auxiliary section joined to the main section with a relatively narrow section of material which functions as a crotch section when worn in the normal position. The auxiliary section, when in the normal position, engages the wearer's legs and completely covers the wearer's lower torso section. When the auxiliary section is lowered, the wearer's complete lower torso is exposed and the legs are not longer engaged and all support of the elastic garment is lost since only the main section shoulders remain in place, not any lower leg engaging section. Also, since the crotch section must be pulled up and fold at the wearer's posterior, its repositioning is complicated, especially for a small child.

Since the main section is not attached to any opening for the wearer's legs, to put this garment on, the wearer must extend the auxiliary section by the narrow crotch section then place her head into the main section, position the arms and pull the lower part down over the stomach area. Then, the wearer must step into the auxiliary section by placing the legs into the auxiliary section openings while the wearer carefully positions the narrow crotch section. Obviously, this procedure is complicated, especially for children, and requires a great deal of physical dexterity and good balance for stepping into the auxiliary section.

SUMMARY OF THE INVENTION

The present invention consists of an elastic garment which has a main section having an opening at the wearer's posterior which is covered by an extension section. The main section engages the wearer's shoulders and the wearer's legs at all times for the maintenance of the full support of the garment.

The extension section also engages the wearer's legs along a portion of that engaged by the main section and extends to form a crotch section common with the main section and extends from the wearer's legs up to a waistband when worn in a normal position. The extension section rear portion covers the posterior opening in the main section.

By simply pulling down the rear portion of the waistband, the extension section is displaced so as to expose the wearer's buttocks and other private parts especially when in the sitting position. The main section remains in position on the wearer's shoulders and remains engaged to the wearer's legs thereby providing full support.

By having the main section and the extension section always engage the wearer's legs, the garment is easily repositioned when the wearer stands up after performing the personal functions.

Also, it becomes a straight forward matter to put the garment on for wear. The wearer simply steps into the neck opening and then places the legs through the leg openings the same as the case in a conventional leotard. The wearer then pulls the extension section up so as to properly position the waistband thereby positioning the extension section covering the wearer's crotch and posterior areas.

The ease with which the wearer can expose her private areas and then stand and reposition the garment allows for the quick performance of bodily functions and also, makes operation feasible for use by young children.

A skirt like extension can be added to the waistband as an alternate embodiment of the present invention. The garment can also function as a bathing suit or as a jumpsuit.

One provision of the present invention is to provide an elastic garment that permits the wearer to displace an extension section of the garment and then assume a sitting position to fully expose private areas.

Another provision of the present invention is to provide an elastic garment that permits the wearer to displace an extension section of the garment and then assume a sitting position to fully expose private areas where the garment remains fully stretched and supportive.

Another provision of the present invention is to provide an elastic garment having a main section and an extension section where the main section engages and is stretched between the wearer's shoulders and legs and remains engaged at all times.

Another provision of the present invention is to provide a one-piece elastic garment having a main section and an extension section which both engage the wearer's legs along a common line.

Still another provision of the present invention is to provide an elastic garment having a one-piece elastic main and extension sections with provisions to commonly engage the wearer's legs for ease of entry.

BRIEF DESCRIPTION OF THE DRAWINGS

FIG. 1 is a front view of the garment of the present invention;

FIG. 2 is a side view of the garment of the present invention in its displaced position on a wearer;

FIG. 3 is a side view of the garment of the present invention in a normal position on a wearer;

FIG. 4 is a side view of the main section of the present invention on a wearer;

FIG. 5 is a front view of the garment of the present invention in its displaced position on a wearer;

FIG. 6 is a perspective view of the garment of the present invention in its displaced position on a wearer in a sitting position;

FIG. 7 is a plan view of the front piece including part of the main section and the extension section of the garment of the present invention;

FIG. 8 is a plan view of the rear piece of the garment of the present invention; and FIG. 9 is a front view of an alternate embodiment of the garment of the present invention.

DETAILED DESCRIPTION OF THE PREFERRED EMBODIMENT

Now referring to FIG. 1, an elastic garment 2 of the present invention consists of a main section 4 having a lower portion 6 and further consisting of an extended section 8 overlaying the lower portion 6 and a crotch section 10. The main section 4 covers the shoulder and chest torso area of the wearer and the lower portion 6 covers the abdominal and posterior areas of the wearer. A crotch section 10 extends downward from the lower portion 6 of the main section 4 covering the wearer's crotch areas and then is extended and expanded in width forming a posterior cover 15 (as shown in FIG. 3) which functions to cover the wearer's posterior. The garment is specifically made of an elastic type material which can be stretched and then released to assume its original shape such as that commonly used for an exercise leotard or a swim suit. The elastic garment 2 has leg openings 12 each of which in conjunction with the crotch section 1 encircle each of the wearer's legs and are both surrounded on the edge by an elastic material. The main section 4 also consists of a neck opening 16 and two shoulder portions 18 where the garment is stretched between the respective shoulder portions 18 and the leg openings 12.

The lower portion 6 of the main section 4 has a posterior opening 14 which exposes the wearer's buttocks when the extended section 8 is pulled in a downward direction. The main section 4 also has a pair of sleeves 19 which encircle the wearer's arms. Other embodiments do not include the sleeve 19 and only include the neck opening 16 and shoulder portions 18.

A waistband 20, commonly made of an elasticized material, is stretched around the wearer's waist and is attached to the extended section 8 at its uppermost edge. Also attached to the waistband 20 is two front bands 22 which, in the preferred embodiment, extend from and are attached to the leg openings 12 up to the waistband 20 and are located at the extreme edge of the extended section 8 where the extended section 8 is void of material between the two front bands 22 at the front of the elastic garment 2.

Referring now to FIG. 2, a side view of the elastic garment 2 of the present invention is shown with the extended section 8 pulled from the wearer's waist in a downward direction so that the waistband 20 lies over the wearer's legs 26. In this manner, the wearer's buttocks 24 are exposed extending through the posterior opening 14 located in the main section 4. The posterior opening 14 is defined by the posterior opening edge 28 which can be reinforced with a separate elastic piece (not shown). The crotch area 25 of the wearer and the wearer's buttocks 24 are now exposed so that by the wearer assuming a sitting position, personal functions can be accomplished. Also, the crotch section 10 is pulled away from the wearer's crotch 25 to facilitate this result. Relatively little garment manipulation or dexterity is required to expose these personal areas while full garment support is provided.

The leg openings 12 are shown having an elastic portion forming a leg band where both the main section and extended section 8 engage the wearer's legs 26. The inside of the material forming the extended section 8 is now exposed to the viewer.

FIG. 3 is a side view of the elastic garment 2 of the present invention where the extended section 8 as shown in a down position in FIG. 2 has been pulled back upward into a normal position where the waistband 20 now engages the wearer's waist. The wearer's buttocks have been covered by the portion of the extended section 8 known as the posterior cover 15. Also shown in FIG. 3 is the front bands 22 as it extends from the waistband 20 in a downward direction meeting and attached to the leg openings 12. The extended section 8 substantially overlaps the main section 4 and is attached to the leg openings 12 from attachment point 9 at approximately the center of the back of the wearer's legs to attachment point 11 at approximately the center of the front of the wearer's legs. In an alternate embodiment, the front bands 22 are eliminated and the extended section 8 not only consists of the posterior cover 15 which extends around the wearer's body and extends from the waistband 20 and is attached to the leg opening 12 but continues around to the stomach area and leaves the leg opening at the front top of the wearer's leg approximately where the front bands 22 would be attached if present and extends horizontally to a like point at the wearer's other leg 26.

FIG. 4 shows a person wearing only the main section 4 with the extended section 8 removed where the crotch section 10 extends towards the wearer's posterior and ends at point 29 where in the complete garment it would extend and be expanded to form the extended section 8 consisting of the posterior cover 15 which would meet the waistband 20 and also extend downward and encircle the leg opening 12 to the front bands 22.

In FIG. 4, the main section 4 extends downward from the wearer's shoulder to the leg opening 12 which in a circumferential fashion including the crotch section 10 engages the wearer's leg 26. In the present invention, the leg opening 12, which is commonly elasticized, remains in position around the wearer's leg 26 at all times even when the extended section 8 (which is not shown) is pulled downward so as to expose the wearer's private sections for performance of bodily functions. Thus, by using the present invention, the elastic garment 2 provides support in a continuous fashion until complete removal.

Also clearly shown in FIG. 4 is the posterior opening 14 in the main section 4 allowing the wearer's buttocks 24 to extend therethrough. To complete the garment as shown in FIG. 4 the extended section 8 would be formed by extension of the crotch section 10 at point 29 and extending in a rearward fashion and a horizontal fashion so as to form the posterior cover 15 up to the waistband 20 and extending forward along and attached to the leg opening 12 where the extended section 8 is formed as one piece with the main section 4 in the preferred embodiment.

Now referring to FIG. 5, a front view of a person wearing the elastic garment 2 of the present invention is shown with the extended section 8 being displaced and pulled down toward the wearer's knees along the wearer's legs 26. The wearer's buttocks are thereby exposed through the posterior opening 14 which is shown as a dashed line defining the opening edge 28. The posterior opening 14 is restricted in size by the side panels 13 and the underneath panels 17 which are connected together and combine to extend and partially cover the wearer's hips and posterior. The underneath panels 17 are attached to the leg openings 12 at the leg portions and extend around the back of the wearer's legs. The side panels 13 and the underneath panels 17 provide for additional support from the garment especially when the posterior cover 15 has been displaced downward. The leg openings 12 are formed at the meeting point of the main section 4 and the extended section 8 and are commonly elasticized so as to form a leg band to engage and encircle the wearer's legs 26. Because the center area of the extended section 8 as defined by the inner edge of the front bands 22 is removed, the wearer's legs are exposed are labeled by numeral 26'. In an alternate embodiment, the front bands would be removed and the extended section 8 would continue to cover the wearer's legs at the areas 26'. Also shown, is the crotch section 10 which has been displaced along with the waistband 20 and now exposes the wearer's private areas in the crotch for performance of bodily functions. Likewise, the posterior cover 15 has been pulled downward so as to uncover the wearer's buttocks 24 as previously discussed.

FIG. 6 shows a wearer of the elastic garment 2 of the present invention in a sitting position where the wearer's buttocks 24 extend outward from the posterior opening 14 as defined by the posterior opening edge 28. By the wearer assuming a sitting position, the buttocks 24 are additionally exposed along with a more functional exposure of the wearer's crotch area 25 by the further displacement of the crotch section 10. Thus, in FIG. 6, the elastic garment 2 is in the same downward position as shown in FIG. 5 but now the wearer is in a sitting position much like that position assumed when bodily functions are to be performed. The elastic garment 2 of the present invention, by maintaining contact with the wearer's legs 26 through leg openings 12 and remaining in position on the wearer's shoulder at shoulder portion 18, the stretch characteristics of the elastic garment 2 are maintained unlike those disclosed in the prior art. The wearer's neck 32 is shown exiting the neck opening 16.

Also clearly shown in FIG. 6 is the two front bands 22 where the extended section 8 is formed by the posterior cover 15 which is continuous and extends from and is attached to the leg opening 12 and to the waistband 20 and encircles wearer's legs 26 up to the front bands 22. The area between the front bands 22 is open in this embodiment.

As discussed supra, the extended section 8 can be designed to continuously cover the outside of the wearer's legs when the extended section 8 is in the pulled down position. In that embodiment, the extended section 8 would leave the leg opening 12 at the point where the front bands 22 would normally join the leg opening 12 with the additional material filling in between those two points and extend up to the waistband 20.

Now referring to both FIGS. 7 and 8, FIG. 7 is a plan view of the front piece 31 of the elastic garment 2 of the present invention with the inside of the elastic material facing the viewer. FIG. 8 is a plan view of the rear piece 49 of the elastic garment 2 which when the front piece 31 is joined to the rear piece 49 the elastic garment 2 of the present invention can be formed. It should be recognized, that the shapes and the dimensions shown in FIGS. 7 and 8 are only approximate and must be customized according to the wearer's dimensions and the exact style desired by the designer. Also, it should be recognized that a variety of fabrics could be used although that commonly used is a stretch material, one example of such a material being spandex.

Now reference will be made to the various edges of the front piece 31 and the rear piece 49 which are joined to form a seam usually by sewing although other methods of joining fabrics could be used. The various components of the front piece 31 and the rear piece 49 could be made individually or as a subassembly or as one complete piece if the technology was available for the necessary forming of the components to function as herein described. For example, in FIG. 8 the sleeves 19 are shown attached to the rear piece 49 thereby forming a subassembly.

The elastic is shown by a wavering line such as that shown to form the leg openings 12 which includes the crotch section 10 and is usually installed after the front piece 31 is joined to the rear piece 49 whereupon the entire edge of both the crotch section 10 and the leg openings 12 are elasticized.

Now detailing the assembly of the front piece 31 as shown in FIG. 7 and the rear piece 49 as shown in FIG. 8, where the front piece 31 and the rear piece 49 as they face the viewer are the inside surface of the material. The exact assembly of the elastic garment 2 of the present invention will now be disclosed referring to FIGS. 7 and 8 concurrently.

The front right shoulder edge **33*a* is joined to the right rear right shoulder edge 50*a* such the neck openings 16 approximately coincide. The front left shoulder edge 33*b* is joined to the rear left shoulder edge 50*b***.

FIG. 8 shows the rear piece 49 including two sleeves 19 which are joined to the rear piece 49 at the rear right inner sleeve seam **53*a* and the rear left inner sleeve seam 53*b* respectively. The sleeves 19 are formed by joining the front right inner sleeve edge 34*a* to the right sleeve seam 52*a* to encircle the wearer's right arm. Likewise, the front left inner sleeve edge 34*b* is joined with the left sleeve edge 52*b* to encircle, in this case, the left arm of the wearer. To complete the sleeves 19 and to connect the front piece 31 to the rear piece 49, upper right sleeve edge 52***a* is joined to front sleeve edge 34*a* and upper left sleeve edge 52*b* is joined to front sleeve edge 34*b*.

To form the main section 4 of the elastic garment 2 of the present invention, the front right torso edge 36*a* is joined to the rear right torso edge 58*a* and likewise the front left torso edge 36*b* is joined to the rear left torso edge 58*b*. Now with slightly more complication, the front right leg edge 38*a* is joined to the section labeled as the front right leg edge 42*a* by joining the points labeled as A and C where the front right leg edge 42*a* of the extended section 8 is folded over so that the point marked as A is towards the center line of the garment with the outside surface of the stretch material now showing to the viewer between points A and B. Front right leg edge 42*a* is then brought up to meet the point marked on the front right leg edge 38*a* as point C and likewise point B is matched to point D. In a like manner, the front left leg edge 38*b* is joined to the front left leg edge 42*b* with points E and G meeting one another by folding over edge 42*b* of the extended section 8 at point F so that point E lies towards the center of the garment with the outside surface of the material now showing between points E and F. Edge 42*b* is then brought up and joined to edge 38*b* so that points E and G meet one another and F and H meet one another. In FIG. 7, the extension section 8 material along the seams formed by 38*a* and 42*a* and 38*b* and 42*b* would now face the viewer.

The rear right edge 60*a* is then joined to the front right edge 40*a* where the outside surfaces of both the front piece 31 and the rear piece 49 face the same direction. Likewise, the rear left edge 60*b* is overlapped to the front left edge 40*b* and later joined during elasticizing of the legs.

To complete the extended section 8, the waistband 20 is formed by joining the right waistband edge 44*a* with the left waistband edge 44*b*.

In an alternate embodiment of the present invention, the front bands 22 are not used and a section of material is added to connect the points labeled in FIG. 7 as A and E and extends and joins both of the extreme edges of the extended section 8 labeled as 61 and 62 this added section of material is joined to the leg openings 12 at points A and E.

Notwithstanding the fact that the elastic garment of present invention is preferably made out of stretch material, it is desirable to reinforce certain areas such as the leg openings 12 which includes the crotch section 10, the waistband 20 and the neck opening 16 with additional pieces of elastic material.

Now referring to FIG. 9, another alternate embodiment of the present invention is shown as 2' and includes a skirt-like portion attached to the waistband 20 and extending downward continuously around the wearer to cover a portion of the wearer's legs 26 (which are not shown). Other variations in design are possible and nothing herein is intended as a limitation in this regard. For instance, the elastic garment 2 of the present invention can be worn under and form part of a jump suit.

The description above refers to particular embodiments of the present invention and it is understood that many modifications may be made without departing from the spirit thereof. The embodiments of the invention disclosed and described in the above specification and drawings are presented merely as examples of the invention. Other embodiments, materials, forms and modifications thereof are contemplated as falling within the scope of the present invention only limited by the claims as follows.

What is claimed is:

1. An elastic garment to cover the wearer's body comprising:

a main section engaging the shoulders and substantially covering the torso of a wearer and extending to individually encircle the wearer's legs thereby forming leg portions, said main section extending to form a crotch section attached to said leg portions for covering the wearer's crotch area and having a posterior opening for exposing the buttocks of the wearer, said posterior opening extending from just below the wearer's waist to said crotch section and further defined by two side panels and two underneath panels where said underneath panels extend around the back of the wearer's legs and are joined to said leg portions and said side panels for providing increased wearer support;

an elastic one piece waistband encircling the wearer's waist;

an extension section attached to said waistband and extending from said waistband, said extension section overlapping said main section and joined to said leg portions from approximately the center of the back of the wearer's legs to approximately the center of the front of the wearer's legs thereby concurrently partially encircling the wearer's legs with said main section, said extension section forming a posterior cover, said posterior cover partially overlapping said main section and covering said posterior opening, said extension section extending from said posterior cover and attaching to said crotch section;

said garment being capable of repeated displacement where said waistband is pulled in a downward direction to displace said extension section and said posterior cover and said crotch section thereby exposing the wearer's posterior and other private areas to allow performance of bodily functions.

2. The elastic garment of claim 1, wherein said main section further comprises two sleeve sections extending from said shoulders and covering a portion of the wearer's arms.

3. The elastic garment of claim 1, wherein said extension section further comprises two front bands extending from a common point at the center of the front of said waistband to said leg portions where said extension section encircles and covers the wearer's posterior and the wearer's hips up to said front bands.

4. The elastic garment of claim 1, wherein said waistband is joined to a skirt section, said skirt section extending in a downward direction thereby covering and encircling the wearer's lower body.

5. The elastic garment of claim 1, wherein said garment comprises a leotard.

6. The elastic garment of claim 1, wherein said garment comprises a swim suit.

7. The elastic garment of claim 1, wherein said garment is secured in a place on the wearer without hardware fasteners permitting easy displacement of said extension section.

* * * * *